United States Patent [19]

Marshall et al.

[11] 4,416,787

[45] Nov. 22, 1983

[54] SOIL RESISTANT YARN FINISH FOR SYNTHETIC ORGANIC POLYMER YARN

[75] Inventors: Robert M. Marshall, Chester; William A. Archie, Petersburgh; Kimon C. Dardoufas, Richmond, all of Va.

[73] Assignee: Allied Corporation, Morris Township, Morris County, N.J.

[21] Appl. No.: 437,977

[22] Filed: Nov. 1, 1982

[51] Int. Cl.[3] ..... D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,519,562 | 7/1970 | Lanner | 252/8.8 |
| 3,773,463 | 11/1973 | Cohen et al. | 8/8 |
| 3,867,187 | 2/1975 | Borenstein | 117/138.8 E |
| 4,192,754 | 3/1980 | Marshall et al. | 252/8.8 |
| 4,320,013 | 3/1982 | Lohman | 252/8.8 |

OTHER PUBLICATIONS

Chemical Abstracts, vol. 88, p. 65, (1978), Item 106718x.
Chemical Abstracts, vol. 89, p. 78, (1978), Item 45329t.
Research Disclosure 19533, p. 283, Jul. 1980.
Research Disclosure 18458, pp. 456–457, Aug. 1979.

*Primary Examiner*—Maria Parrish Tungol

[57] ABSTRACT

A yarn finish composition is disclosed for incorporation with synthetic organic polymer yarn or yarn products to render the same oil repellent and resistant to soiling. The composition comprises (a) a quaternary ammonium salt selected from the group consisting of trialkyl dodecyl ammonium salt and cocotrialkyl ammonium salt, wherein the alkyl is methyl or ethyl and the anion is selected from the group consisting of chloride, bromide, iodide, sulfate, ethosulfate, methosulfate and mixtures thereof, and (b) a fluorochemical compound consisting of polycarboxybenzene esterified with certain partially fluorinated alcohols and with hydroxy-containing organic radicals such as 2-hydroxyethyl, glyceryl, and chlorohydryl or bromohydryl.

30 Claims, No Drawings

SOIL RESISTANT YARN FINISH FOR SYNTHETIC ORGANIC POLYMER YARN

BACKGROUND OF THE INVENTION

1. Field of the Invention

This invention relates to a yarn finish composition. More particularly, this invention relates to a yarn finish composition for incorporation with synthetic organic polymer yarn or yarn products to render the same oil repellent and resistant to soiling. This invention further relates to emulsions and spin finishes which include the aforementioned yarn finish composition as a component thereof.

2. Description of the Prior Art

The treatment of textiles with fluorochemicals to impart oil repellency and soil resistance has been known for some time. See the discussion in U.S. Pat. Nos. 4,134,839 to Marshall, 4,192,754 to Marshall et al., 4,209,610 to Mares et al., 4,283,292 to Marshall et al. and 4,317,736 to Marshall, all of which are hereby incorporated by references. Research has been carried out to develop an alternate, cationic emulsification system for the fluorocarbon compounds of U.S. Pat. No. 4,209,610 to Mares et al.

SUMMARY OF THE INVENTION

The present invention provides a yarn finish composition for incorporation with synthetic organic polymer yarn or yarn products to render the same oil repellent and resistant to soiling.

The yarn finish composition of the present invention comprises (a) about 15 to 80, more preferably 20 to 50, weight percent of a quaternary ammonium salt selected from the group consisting of trialkyldodecyl ammonium anion and cocotrialkyl ammonium anion, wherein the alkyl is moiety or ethyl and the anion is selected from the group consisting of chloride, bromide, iodide, sulfate, ethosulfate, methosulfate and mixtures thereof; and (b) about 20 to 85, more preferably 50 to 80, weight percent of a fluorochemical compound. The fluorochemical compound has the formula

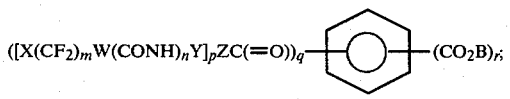

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

The preferred quaternary ammonium salts are trimethyldodecyl ammonium chloride and cocotrimethyl ammonium sulfate. Prior to combination with the fluorochemical compound, the salt may be in solution, preferably of 0 to 100 weight percent water, 0 to 100 weight percent ethylene or propylene glycol, preferably the latter, and 0 to 15 weight percent isopropanol.

The yarn finish composition of the present invention can be applied in any known manner to synthetic organic polymer fiber, yarn or yarn products, e.g., by spraying the fiber, yarn or yarn products or by dipping them into or otherwise contacting them with the composition. It is preferred that an emulsion of water and approximately 1.5 to 40 percent by weight of the emulsion of the composition, be formed for application to the yarn or yarn products. This emulsion can be applied during spinning of the yarn with, preferably, a conventional spin finish being applied to the yarn just prior to or subsequent to application of the emulsion, e.g., by tandem (in series) kiss rolls. The emulsion can alternatively be applied as an overfinish during beaming of the yarn or at any other processing stage. Staple fiber can be treated by spraying. Further, fabric or carpet made from synthetic organic polymer yarn can be treated with the emulsion; e.g., by spraying, padding, or dipping in a conventional manner.

In the most preferred embodiment of the present invention, the yarn finish composition forms one of the components of the sole spin finish for application to synthetic organic polymer yarn during spinning of the yarn. The spin finish of the present invention comprises about 1.5 to 25, more preferably 2 to 20, percent by weight of a first noncontinuous phase, about 50 to 96, more preferably 60 to 93, percent by weight of water, and about 2.5 to 30, more preferably 5 to 20, percent by weight of a second noncontinuous phase. The first noncontinuous phase comprises the yarn finish composition as defined above.

The minimum acceptable percentage by weight for the spin finish of the first noncontinuous phase is believed to depend on the maximum temperature measured on the yarn and/or yarn product in processing subsequent to application of the spin finish. In high temperature processing where the yarn and/or yarn product temperature exposure is in excess of 110° C., preferably in the range of 140° to 180° C., 0.2 to 1.5 percent by weight of yarn, of oil, is applied as spin finish, and 0.18 to 1.8 percent by weight of yarn, of oil, remains on the yarn after high temperature processing. A minimum of 0.075 percent by weight of yarn, of the fluorochemical compound, after high temperature processing of the yarn, has been found to provide effective oil repellency and resistance to soiling. In low temperature processing where the yarn and/or yarn product temperature exposure is about 110° C. or less, preferably in the range of 100° to 110° C., 0.2 to 1.5 percent by weight of yarn, of oil, is applied as spin finish, and 0.19 to 1.4 percent by weight of yarn, of oil, remains on the yarn after low temperature processing. As little as about 0.12 percent by weight of yarn, of the fluorochemical compound, after low temperature processing of the yarn, has been found to provide effective oil repellency and resistance to soiling.

The second noncontinuous phase is preferably an emulsion, optionally aqueous, which must be capable of being emulsified with the first noncontinuous phase and water without separation of any of the component parts of the spin finish.

The most preferred second noncontinuous phase of this spin finish comprises 20 to 70 percent by weight of coconut oil, 10 to 50 percent by weight of polyoxyalkylene oleyl ether containing 5 to 20 moles of alkylene oxide per mole of oleyl alcohol, 5 to 30 percent by weight of polyoxyalkylene stearate containing 4 to 15 moles of alkylene oxide per mole of stearic acid. The second noncontinuous phase can also be 100 percent by weight of a polyalkylene glycol ether. A further second noncontinuous phase of the spin finish comprises 40 to 65 percent by weight of coconut oil, 15 to 35 percent by weight of polyoxyalkylene oleyl ether containing 5 to 20 moles of alkylene oxide per mole of oleyl alcohol, 2 to 10 percent by weight of polyoxyalkylene nonyl phenol containing 5 to 15 moles of alkylene oxide per mole of nonyl phenol, and 5 to 25 percent by weight of polyoxyalkylene stearate containing 4 to 15 moles of alkylene oxide per mole of stearic acid. Another satisfactory second noncontinuous phase of the spin finish comprises 40 to 65 percent by weight of coconut oil, 15 to 35 percent by weight of polyoxyalkylene oleyl ether containing 8 to 20 moles of alkylene oxide per mole of oleyl alcohol, 2 to 10 percent by weight of polyoxyalkylene oleate containing 2 to 7 moles of alkylene oxide per mole of oleic acid, and 5 to 25 percent by weight of polyoxyalkylene castor oil containing 2 to 10 moles of alkylene oxide per mole of castor oil. Another satisfactory second noncontinuous phase comprises 40 to 50 percent by weight of an alkyl stearate wherein the alkyl group contains 4 to 8 carbon atoms, 25 to 30 percent by weight of sorbitan monooleate, and 25 to 30 percent by weight of polyoxyalkylene tallow amine containing 18 to 22 moles of alkylene oxide per mole of tallow amine.

The alkylene oxide used in the above second noncontinuous phases is preferably ethylene oxide although propylene oxide or butylene oxide could be used.

This invention includes also polyamide and polyester and other synthetic polymer fibers, yarns and yarn products having incorporated therewith the yarn composition, emulsion or spin finishes as above defined.

The spin finishes of the present invention, in addition to rendering yarn treated therewith oil repellent and resistant to soiling, provide lubrication, static protection and plasticity to the yarn for subsequent operations, such as drawing and steam texturing and other operations for production of bulked yarn, particularly bulked carpet yarn or textured apparel yarn.

Throughout the present specification and claims the term "yarn," "yarn product," "synthetic organic polymer" and "during commercial processing of the yarn" are as defined in U.S. Pat. No. 4,192,754 to Marshall et al.

DESCRIPTION OF THE PREFERRED EMBODIMENT

The preferred fluorochemical compounds which are useful in the yarn finish composition, emulsion, and spin finishes of the present invention are as described in the preferred embodiment of U.S. Pat. No. 4,192,754 to Marshall et al., hereby incorporated by reference.

The invention will now be further described in the following specific examples which are to be regarded solely as illustrative and not as restricting the scope of the invention. In particular, although the examples are limited to polyamide and polyester yarns and yarn products, it will be appreciated that the yarn finish composition, emulsion and spin finishes of the present invention can be applied to yarn made from any synthetic organic polymer filaments and products thereof. Further, although the examples are limited to sodium dioctyl sulfosuccinate, the dioctyl sulfosuccinates useful in this invention are of the salts of dioctyl sulfosuccinates, especially the ammonium salt and the alkali metal, particularly sodium and potassium, salts of a dicotyl ester of sulfosuccinic acid; similarly, with respect to the salt of a polycarboxylic acid, the salt of a sulfonated naphthalene-formaldehyde condensate, and the salt of an alkyl naphthalene sulfonate. In the following examples, parts and percentages employed are by weight unless otherwise indicated.

EXAMPLES 1–35

The fluorochemical used in this example was a mixture of pyromellitates having the following structure:

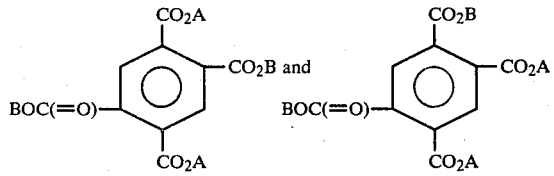

(a) para (50%) (b) meta (50%)

$A=(CH_2)_2(CF_2)_nCF_3$ where n is 5–13.
$B=CH_2CHOHCH_2Cl$.

For convenience, this mixture of pyromellitates is hereinafter called Fluorochemical Composition-1. In Example 1, four parts of Fluorochemical Composition-1 were added to 4 parts of cocotrimethyl ammonium sulfate, available from American Hoechst Corporation under the name Hostastat® TP 1749M, and the mixture was heated to 90° C. at which temperature a clear homogeneous solution was formed. This solution was added with stirring to 92 parts of water heated to 90° C., and the resultant emulsion was then cooled to 60° C. The oil particles of this emulsion had a particle size of less than 1 micron. Stability of the emulsion was good for 30 days.

The procedure of Example 1 was repeated in each of Examples 2–35 with the formulations by parts as set forth in Table I.

With reference to Table I, it can be seen that the emulsions of Examples 1–5 and 6 exhibited good stability while those of Examples 6–35, deemed comparative, exhibited poor stability by separating or fair/questionable stability.

EXAMPLE 36

About 10.2 parts of Fluorochemical Composition-1 were added to 34 parts of a 30 percent active emulsion of water and cocotrimethyl ammonium sulfate, and the combination was heated to 85°–90° C., at which temperature, the Fluorochemical Composition melted to form a clear, homogeneous first noncontinuous phase. This first noncontinuous phase was then heated to 85° C. and combined with 307.8 parts of water at 85° C. in the Homogenizer Triplex 2000A sonolator by Sonic Corporation, to form an emulsion. The oil particles in this emulsion had a particle size of less than one micron, and the emulsion was stable for at least 30 days without signs of separation. For convenience, this emulsion is called Emulsion-1.

It should be noted that in forming Emulsion-1 or the first noncontinuous phase above, Fluorochemical Composition-1 and the solution can be heated to a temperature of between approximately 80° C. and 95° C. The temperature of the water should correspond approximately to that of the first noncontinuous phase when it is added to the water. The resultant emulsion can be cooled to a temperature between approximately 50° C. and 85° C.

To Emulsion-1 was added 48 parts of a second noncontinuous phase at 70° C. (60° to 80° C. acceptable) and consisting essentially of 50 percent by weight of coconut oil, 30 percent by weight of polyoxyethylene oleyl ether containing 10 moles of ethylene oxide per mole of oleyl alcohol, and 20 percent by weight of polyoxyethylene stearate containing 8 moles of ethylene oxide per mole of stearic acid. The resulting emulsion was stable for at least 30 days and was suitable for use as a spin finish as described hereinafter. For convenience, this emulsion is called Spin Finish-1.

A typical procedure for obtaining polymer pellets for use in this example is as follows. A reactor equipped with a heater and stirrer is charged with a mixture of 1520 parts of epsilon-caprolactam and 80 parts of aminocaproic acid. The mixture is then blanketed with nitrogen and stirred and heated to 255° C. over a one-hour period at atmospheric pressure to produce a polymerization reaction. The heating and stirring is continued at atmospheric pressure under a nitrogen sweep for an additional four hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml of 90 percent formic acid at 25° C. (ASTM D-789-62T).

Polyamide polymer pellets prepared in accordance, generally, with the procedure above were melted at about 255° to 265° C. and melt extruded under pressure of about 1500 to 2000 psig through a 70-orifice spinnerette to produce an undrawn yarn having about 2920 denier. Spin Finish-1 was applied to the yarn which was then drawn at about 3.0 times the extruded length and textured with a steam jet at a temperature of 180° to 200° C. (high temperature) to produce a bulked yarn that is particularly useful for production of carpets and upholstery fabrics.

In the finish circulation system, a finish circulating pump pumped Spin Finish-1 from a supply tank into a tray in which a kiss roll turned to pick up finish for application to the moving yarn in contact with the kiss roll. Finish from the tray overflowed into the supply tank. There was no separation of Spin Finish-1 in the finish circulation system.

Some of the bulked yarn was formed into a skein which was nontumbled, 2-ply twist set and autoclaved at 132.2° C. The yarn had a textured denier of 2492. Some of this yarn was taken off the package and measured for crimp elongation before boil (15.05 percent) then boiled for thirty minutes in water and measured again for crimp elongation after boil (17.70 percent). Total shrinkage was 4.6 percent. The amount of fluorine on yarn was 493 ppm. Some of the yarn was formed into knitted sleeves which were dyed a standard color and exposed 100 hours to xenon to determine dye lightfastness [AATCC Test Method 16E-1978 (XRF-1 for 20 AFU)] as gray scale 2–3 (AATCC Evaluation Procedure No. 1) and CIE ΔE 4.55. Some of the knitted sleeves were dyed for evaluation of ozone fading (AATCC Test Method 129-1975)—Laurel Crest 3005:1 cy—G.S.1/CIE ΔE 7.05, and 5 cy—G.S.1/CIE ΔE 17.63; and Laurel Crest 3008:1 cy—G.S.2/CIE ΔE 3.60, and 5 cy—G.S.1/CIE ΔE 13.26. Some of this yarn was formed into a twenty-seven oz/yd$^2$ carpet having 0.19 in. gauge. Some of the carpet was beck dyed and evaluated for oil repellency in accordance with AATCC Test Method 118-1975 (described in U.S. Pat. No. 4,192,754 to Marshall et al.); the carpet had a repellency rating of 4–5. The carpet was dyed soiling yellow. Some of it was stained in three different areas with, respectively, cherry Kool-Aid, coffee with sugar and red wine; these stains were evaluated and ranked (as compared with other stained carpets) with 1=best and 5=worst. The weighed average for this carpet was 1.7. Part of the unstained carpet was steam cleaned twice, stained and similarly evaluated; the weighted average for this carpet was 2.7.

Some of the bulked yarn, which had a textured denier of about 1080, was tested for percent oil on yarn at 0.75 and for xenon dye lightfastness and ozone fading as above: xenon dye lightfastness: C.S.3/CIE ΔE 3.15 and ozone fading: Laurel Crest 3005: 1 cy—G.S.2–3/CIE ΔE 3.91, and 5 cy—G.S.1/CIE ΔE 11.52; and Laurel Crest 3008:1 cy—G.S.3/CIE ΔE 2.22, and 5 cy—G.S.1/ΔE 6.64.

EXAMPLES 37–40

The procedure of Example 36 is repeated in each of Examples 37–40 utilizing Spin Finishes -2, -3, -4 and -5, respectively, in lieu of Spin Finish-1. Acceptable properties are obtained. It should be noted that anionic second noncontinuous phases probably would not be compatible with the present system as they bear an overall negative charge in the organic portion—specifically, second noncontinuous phases containing phosphated or sulfated portions probably would be incompatible.

EXAMPLE 41

Polycaproamide polymer having about 27±1 amine end groups and about 20 carboxyl end groups, a formic acid viscosity of about 55±2.0 and an extractables level of less than about 2.8 percent, is supplied at a rate of about 125 pounds per hour per spinnerette (250 pounds per hour per position) to a spinning position which comprises two spin pots each containing one spinnerette. Each spinnerette has 300 Y-shaped orifices. The filaments are extruded from each spinnerette into a quench stack for cross-flow quenching. Each end of quenched filaments has one of the spin finishes of Examples 4–13 applied in, respectively. Examples 14–23, at about 4.8 to 5 percent wet pickup and subsequently is deposited in a tow can. The undrawn denier per filament of the yarn is about 50, and the modification ratio is between about 2.9 to 3.4. Subsequently, yarn from several tow cans is combined in a creel into a tow and is stretched in a normal manner at a stretch ratio of about 2.9 in a tow stretcher. The tow is then fed through a stuffing box crimper using 10 pounds of steam to produce about 11 crimps per inch and deposited in an autoclave cart for batch crimp setting about 107° to 113° C. (225° to 235° F.). At the end of the autoclave cycle, the tow is fed into a conventional cutter, is cut into staple yarn, and is baled. It is believed that the maximum temperature exposure measured on the yarn would be 110° C. or less; in this regard, the above-described process is deemed "low temperature."

In the finish circulation system, a finish circulating pump pumps the spin finish from the supply tank into a tray in which a kiss roll turns to pick up finish for application to the moving yarn in contact with the kiss roll. Finish from the tray overflows into the supply tank.

The cut staple yarn is made into a carpet by conventional means and is evaluated for oil repellency by AATCC Test No. 118-1975 as outlined in Example 3 of U.S. Pat. No. 4,192,754 to Marshall et al. The carpet made from polyamide yarn prepared in accordance with the present example has an acceptable oil repellency.

EXAMPLES 42–46

Polyethylene terephthalate pellets are melted at about 290° C. and are melt extruded under a pressure of about 2500 psig through a 34-orifice spinnerette to produce a partially oriented yarn having about 250 denier. The spin finishes of Table II are applied to the yarn in, respectively, Examples 42–46 via a kiss roll in amount to provide about 0.6 percent by weight of oil on the yarn. The yarn is then draw-textured at about 1.3 times the extruded length and at a temperature of 150° to 175° C. to produce a bulked yarn having a drawn denier of about 150. Yarn produced in this manner is particularly useful for production of carpets and fine apparel. Bulked yarn made in accordance with these examples has an acceptable mechanical quality rating. Fabric made from yarn prepared in accordance with each of the present examples has an acceptable oil repellency.

DISCUSSION

As the preceding examples illustrate, the compositions, emulsions and spin finishes of the present invention render synthetic organic polymer yarn and/or yarn products with which they are incorporated oil repellent and resistant to soiling without adversely affecting other characteristics of the yarn and/or yarn products.

TABLE I

EMULSION STABILITY DATA (FORMULATION BY PARTS)

| | Examples | | | | | | | | | | | | | | | | | |
|---|---|---|---|---|---|---|---|---|---|---|---|---|---|---|---|---|---|---|
| Component* | 1 | 2 | 3 | 4 | 5 | 6 | 7 | 8 | 9 | 10 | 11 | 12 | 13 | 14 | 15 | 16 | 17 | 18 |
| 1 | 4 | 2.7 | 8 | 4 | 8 | 8 | 8 | 8 | 4 | 4 | 4 | 4 | 4 | 4 | 2.4 | 2.4 | 2.4 | 2.4 |
| 2 | 92 | 90 | 88 | 92 | 88 | 88 | 88 | 88 | 92 | 92 | 92 | 92 | 92 | 92 | 95.2 | 95.2 | 95.2 | 95.2 |
| 3 | 4 | 1.1 | 4 | — | — | — | — | — | — | — | — | — | — | — | — | — | — | — |
| 4 | — | — | — | 4 | 4 | — | — | — | — | — | — | — | — | — | — | — | — | — |
| 5 | — | — | — | — | — | 4 | — | — | — | — | — | — | — | — | — | — | — | — |
| 6 | — | — | — | — | — | — | 4 | — | — | — | — | — | — | — | — | — | — | — |
| 7 | — | — | — | — | — | — | — | 4 | — | — | — | — | — | — | — | — | — | — |
| 8 | — | — | — | — | — | — | — | — | 4 | — | — | — | — | — | — | — | — | — |
| 9 | — | — | — | — | — | — | — | — | — | 4 | — | — | — | — | — | — | — | — |
| 10 | — | — | — | — | — | — | — | — | — | — | 4 | — | — | — | — | — | — | — |
| 11 | — | — | — | — | — | — | — | — | — | — | — | 4 | — | — | — | — | — | — |
| 12 | — | — | — | — | — | — | — | — | — | — | — | — | 4 | — | — | — | — | — |
| 13 | — | — | — | — | — | — | — | — | — | — | — | — | — | 4 | — | — | — | — |
| 14 | — | — | — | — | — | — | — | — | — | — | — | — | — | — | 2.4 | — | — | — |
| 15 | — | — | — | — | — | — | — | — | — | — | — | — | — | — | — | 2.4 | — | — |
| 16 | — | — | — | — | — | — | — | — | — | — | — | — | — | — | — | — | 2.4 | — |
| 17 | — | — | — | — | — | — | — | — | — | — | — | — | — | — | — | — | — | 2.4 |
| 18 | — | — | — | — | — | — | — | — | — | — | — | — | — | — | — | — | — | — |
| 19 | — | — | — | — | — | — | — | — | — | — | — | — | — | — | — | — | — | — |
| 20 | — | — | — | — | — | — | — | — | — | — | — | — | — | — | — | — | — | — |
| 21 | — | — | — | — | — | — | — | — | — | — | — | — | — | — | — | — | — | — |
| 22 | — | — | — | — | — | — | — | — | — | — | — | — | — | — | — | — | — | — |
| 23 | — | — | — | — | — | — | — | — | — | — | — | — | — | — | — | — | — | — |
| 24 | — | — | — | — | — | — | — | — | — | — | — | — | — | — | — | — | — | — |
| 25 | — | — | — | — | — | — | — | — | — | — | — | — | — | — | — | — | — | — |
| 26 | — | — | — | — | — | — | — | — | — | — | — | — | — | — | — | — | — | — |
| 27 | — | — | — | — | — | — | — | — | — | — | — | — | — | — | — | — | — | — |
| 28 | — | — | — | — | — | — | — | — | — | — | — | — | — | — | — | — | — | — |
| 29 | — | — | — | — | — | — | — | — | — | — | — | — | — | — | — | — | — | — |
| 30 | — | — | — | — | — | — | — | — | — | — | — | — | — | — | — | — | — | — |
| Stability** | G | G | G | G | G | X | X | X | X | X | X | X | X | X | X | X | X | F |

| | Examples | | | | | | | | | | | | | | | | |
|---|---|---|---|---|---|---|---|---|---|---|---|---|---|---|---|---|---|
| Component* | 19 | 20 | 21 | 22 | 23 | 24 | 25 | 26 | 27 | 28 | 29 | 30 | 31 | 32 | 33 | 34 | 35 |
| 1 | 2.4 | 2.4 | 2.4 | 2.4 | 2.4 | 2.4 | 2.4 | 2.4 | 2.4 | 2.4 | 2.4 | 2.4 | 2.4 | 1.2 | 1.2 | 1.2 | 1.6 |
| 2 | 95.2 | 95.2 | 95.2 | 95.2 | 95.2 | 95.2 | 95.2 | 95.2 | 95.2 | 95.2 | 95.2 | 95.2 | 95.2 | 95.2 | 95.2 | 95.2 | 95.2 |
| 3 | — | — | — | — | — | — | — | — | — | — | — | — | — | — | — | — | — |
| 4 | — | — | — | — | — | — | — | — | — | — | — | — | — | — | — | — | — |
| 5 | — | — | — | — | — | — | — | — | — | — | — | — | — | — | — | — | — |
| 6 | — | — | — | — | — | — | — | — | — | — | — | — | — | — | — | — | — |
| 7 | — | — | — | — | — | — | — | — | — | — | — | — | — | — | — | — | — |
| 8 | — | — | — | — | — | — | — | — | — | — | — | — | — | — | — | — | — |
| 9 | — | — | — | — | — | — | — | — | — | — | — | — | — | — | — | — | — |
| 10 | — | — | — | — | — | — | — | — | — | — | — | — | — | — | — | — | — |
| 11 | — | — | — | — | — | — | — | — | — | — | — | — | — | — | — | — | — |
| 12 | — | — | — | — | — | — | — | — | — | — | — | — | — | — | — | — | — |
| 13 | — | — | — | — | — | — | — | — | — | — | — | — | — | — | — | — | — |
| 14 | — | — | — | — | — | — | — | — | — | — | — | — | — | — | — | — | — |
| 15 | — | — | — | — | — | — | — | — | — | — | — | — | — | — | — | — | — |
| 16 | — | — | — | — | — | — | — | — | — | — | — | — | — | — | — | — | — |
| 17 | — | — | — | — | — | — | — | — | — | — | — | — | — | — | — | 3.6 | 1.6 |
| 18 | 2.4 | — | — | — | — | — | — | — | — | — | — | — | — | — | — | — | — |

TABLE I-continued

EMULSION STABILITY DATA (FORMULATION BY PARTS)

| | | | | | | | | | | | | | | | | | |
|---|---|---|---|---|---|---|---|---|---|---|---|---|---|---|---|---|---|
| 19 | — | 2.4 | — | — | — | — | — | — | — | — | — | — | — | — | — | — | — |
| 18 | — | — | 2.4 | — | — | — | — | — | — | — | — | — | — | — | — | — | — |
| 21 | — | — | — | 2.4 | — | — | — | — | — | — | — | — | — | — | — | — | — |
| 22 | — | — | — | — | 2.4 | — | — | — | — | — | — | — | — | — | — | — | — |
| 23 | — | — | — | — | — | 2.4 | — | — | — | — | — | — | — | 3.6 | — | — | — |
| 24 | — | — | — | — | — | — | 2.4 | — | — | — | — | — | — | — | — | — | — |
| 25 | — | — | — | — | — | — | — | 2.4 | — | — | — | — | — | — | — | — | — |
| 26 | — | — | — | — | — | — | — | — | 2.4 | — | — | — | — | — | — | — | — |
| 27 | — | — | — | — | — | — | — | — | — | 2.4 | — | — | — | — | 3.6 | — | 2.6 |
| 28 | — | — | — | — | — | — | — | — | — | — | 2.4 | — | — | — | — | — | — |
| 29 | — | — | — | — | — | — | — | — | — | — | — | 2.4 | — | — | — | — | — |
| 30 | — | — | — | — | — | — | — | — | — | — | — | — | 2.4 | — | — | — | — |
| Stability** | X | X | X | X | X | F | X | X | X | F | X | X | X | X | X | X | G |

*Number corresponds to footnote.
**G denotes stability, F denotes fair/questionable stability and X denotes separation, after 24 hours.

FOOTNOTES TO TABLE I

1. Fluorochemical Composition-1.
2. Water.
3. Hostastat TP 1749 M—cocotrimethyl ammonium sulfate, American Hoechst Corporation.
4. ARQUAD ®12-50—trimethyldodecyl ammonium chloride, 50% active, Armak Company.
5. ARQUAD ®16-50—trimethylhexadecyl ammonium chloride, 50% active, Armak Company.
6. ARQUAD ®S-50—trimethylsoya ammonium chloride, 50% active, Armak Company.
7. ARQUAD ®T-50—trimethyl tallow ammonium chloride, 50% active, Armak Company.
8. Genamin KDM—alkyltrimethyl ammonium chloride (alkyl=$C_{20}$-$C_{22}$), American Hoechst Corporation.
9. Genamin KDB—eicosyl/docosyl dimethyl-benzyl ammonium chloride ($C_{20}$-$C_{22}$), American Hoechst Corporation.
10. Genamin CTAC—alkyltrimethyl ammonium chloride ($C_{16}$), American Hoechst Corporation.
11. Genamin KS5—polyoxyethylstearyl ammonium chloide, American Hoechst Corporation.
12. Genamin T-050—aminoxathylate based on tallow fatty amine, American Hoechst Corporation.
13. Prapagen WK—distearyldimethyl ammonium chloride, American Hoechst Corporation.
14. Monateric Cy Na-50—capryloamphopropionate, 50% active, Mona Industries, Inc.
15. Monateric 1000—capryloamphopropionate, Mona Industries, Inc.
16. Monateric CM36—cocoamphoglycinate, 36% active, Mona Industries, Inc.
17. Monateric CSH-32—cocoamphocarboxyglycinate, 32% active, Mona Industries, Inc.
18. Monateric 805—cocoamphocarboxyglycinate/-cocoamido MIPA-sulfosuccinate, Mona Industries, Inc.
19. Monateric LMM 30—lauroamphoglycinate, 30% active, Mona Industries, Inc.
20. Monateric CDX-38—cocoamphocarboxy glycinate, 38% active, Mona Industries, Inc.
21. Monateric ISA-35—isostearoamphopropionate, 35% active, Mona Industries, Inc.
22. Monateric LF Na-50—mixed short chain propionate, 50% active, Mona Industries, Inc.
23. Monateric 810-A-50—caprylic/capric propionates, 50% active, Mona Industries, Inc.
24. Monateric LF-100—mixed short chain propionate, 100% active, Mona Industries, Inc.
25. Monateric CEM-38—cocoamphopropionate, 38% active, Mona Industries, Inc.
26. Monateric ADA—cocoamidopropyl betaine, Mona Industries, Inc.
27. Monateric CA-35—coconut amphoteric-$C_{12}$ imidazoline reacted with acrylic acid—called cocoamphopropionate, 35% active, Mona Industries, Inc.
28. Monateric 811—caprylic propionate, Mona Industries, Inc.
29. Monateric 985A—lauroamphoglycinate, sodium tridecetl sulfate, Mona Industries, Inc.
30. Monateric CAB—cocoamidopropyl betaine, Mona Industries, Inc.

TABLE II

SPIN FINISH FORMULATIONS (PERCENT)

| Component | −1 | −2 | −3 | −4 | −5 |
|---|---|---|---|---|---|
| Coconut Oil | 50 | 55 | 55 | — | — |
| POE(10)[1] Oleyl Alcohol | 30 | 25 | 25 | — | — |
| POE(9)[1] Nonyl Phenol | — | 5 | — | — | — |
| POE(8)[1] Stearic Acid | 20 | 15 | — | — | — |
| POE(5)[1] Oleic Acid | — | — | 5 | — | — |
| POE(5)[1] Castor Oil | — | — | 15 | — | — |
| Butyl Stearate | — | — | — | 44.5 | — |
| Sorbitan Monooleate | — | — | — | 27.75 | — |
| POE(20)[1] Tallow Amine | — | — | — | 27.75 | — |
| Polyalkylene Glycol Ether[2] | — | — | — | — | 100 |

[1]Moles ethylene oxide per mole base material.
[2]UCON 50-HB-100

We claim:

1. A yarn finish composition comprising:

a. 15 to 80 weight percent of a quaternary ammonium salt selected from the group consisting of alkyl dodecyl ammonium salt and cocotrialkyl ammonium salt, wherein the alkyl is methyl or ethyl and the anion of the salt is selected from the group consisting of chloride, bromide, iodide, sulfate, ethosulfate, methosulfate and mixtures thereof; and b. 20 to 85 weight percent of a fluorochemical compound having the formula

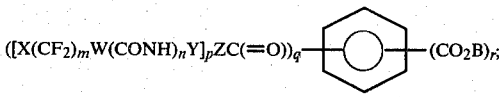

wherein the attachment of the fluorinated radials and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2$-$CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

2. An emulsion of water and 1.5 to 40 percent by weight of said emulsion of said composition as defined in claim 1.

3. The composition of claim 1 wherein the anion is chloride.

4. The composition of claim 1 wherein the anion is sulfate.

5. The composition of claim 1 wherein the quaternary ammonium salt is in a solution of water, isopropanol and propylene glycol.

6. The composition of claim 1 wherein the fluorochemical compound is a trimellitate, a pyromellitate, or a bis(diamide)/ester of trimellitic acid or of pyromellitic acid, wherein each fluorinated radical, of formula $X(CF_2)_mW(CONH)_nY$, has a main chain containing at least six carbon atoms and contains at least four perfluorinated carbon atoms in the radical.

7. The composition of claim 1 wherein the fluorochemical compound is a mixture of pyromellitates having the structure

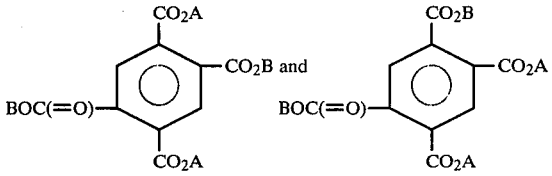

(a) para (50%) (b) meta (50%)

$A=(CH_2)_2(CF_2)_nCF_3$ *where n is* 5–13

$B=CH_2CHOHCH_2Cl$.

8. A polyamide yarn having incorporated therewith the composition of claim 1.

9. A polyester yarn having incorporated therewith the composition of claim 1.

10. The polyamide yarn product having incorporated therewith the composition of claim 1.

11. The polyester yarn product having incorporated therewith the composition of claim 1.

12. A spin finish for yarn, made from synthetic organic polymer, to be processed into a yarn that is oil repellent and resistant to soiling, said spin finish comprising:

a. 1.5 to 25 percent by weight of said spin finish of a first noncontinuous phase comprising:

i. 15 to 80 weight percent of a quaternary ammonium salt selected from the group consisting of trialkyl dodecyl ammonium salt and cocotrialkyl ammonium salt, wherein the alkyl is methyl or ethyl and the anion of the salt is selected from the group consisting of chloride, bromide, iodide, sulfate, ethosulfate, methosulfate and mixtures thereof; and ii. 20 to 85 weight percent of a fluorochemical compound having the formula

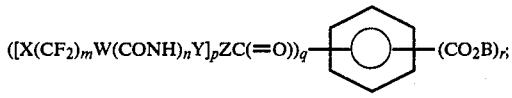

wherein the attachment of the fluorinated radicals and the radicals of $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different;

b. 50 to 96 percent by weight of said spin finish of water; and c. 2.5 to 30 percent by weight of said spin finish of a second noncontinuous phase which is capable of being emulsified with said first noncontinuous phase and said water without separation of any of the component parts of said spin finish.

13. The spin finish of claim 12 wherein none of the component parts of said spin finish separate during commercial processing of said yarn.

14. The spin finish of claim 12 wherein the fluorochemical compound is a trimellitate, a pyromellitate, or a bis(diamide)/ester of trimellitic acid or of pyromellitic acid, wherein each fluorinated radical, of formula $X(CF_2)_mW(CONH)_mY$, has a main chain containing at least six carbon atoms and contains at least four perfluorinated carbon atoms in the radical.

15. A polyamide yarn having incorporated therewith the spin finish of claim 14.

16. A polyester yarn having incorporated therewith the spin finish of claim 14.

17. The spin finish of claim 12 wherein the fluorochemical compound is a mixture of pyromellitates having the structure:

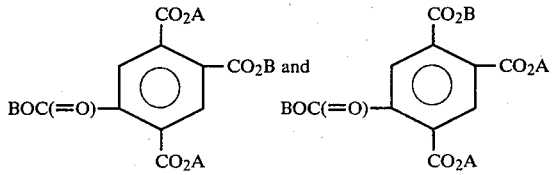

(a) para (50%) (b) meta (50%)

$A=(CH_2)_2CF_2)_nCF_3$ where n is 5–13

$B=CH_2CHOHCH_2Cl$.

18. A polyamide yarn having incorporated therewith the spin finish of claim 17.

19. A polyester yarn having incorporated therewith the spin finish of claim 17.

20. The spin finish of claim 12 wherein the anion is chloride.

21. The spin finish of claim 12 wherein the anion is sulfate.

22. The spin finish of claim 12 wherein said second noncontinuous phase is selected from the group consisting of:

a. 40 to 65 percent by weight of coconut oil, 15 to 35 percent by weight of polyoxyalkylene oleyl ether containing 5 to 20 moles of alkylene oxide per mole of olely alcohol, 2 to 10 percent by weight of polyoxyalkylene nonyl phenol containing 5 to 15 moles of alkylene oxide per mole of nonyl phenol, about 5 to 25 percent by weight of polyoxyalkylene stearate containing 4 to 15 moles of alkylene oxide per mole of stearic acid;

b. 40 to 65 percent by weight of coconut oil, 15 to 35 percent by weight of polyoxyalkylene oleyl ether containing 8 to 20 moles of alkylene oxide per mole of oleyl alcohol, 2 to 10 percent by weight of polyoxyalkylene oleate containing 2 to 7 moles of alkylene oxide per mole of oleic acid, and 5 to 25 percent by weight of polyoxyalkylene castor oil containing 2 to 10 moles of alkylene oxide per mole of castor oil;

c. 40 to 50 percent by weight of an alkyl stearate wherein the alkyl group contains 4 to 18 carbon atoms, 25 to 30 percent by weight of sorbitan monooleate, and 25 to 30 percent by weight of polyoxyalkylene tallow amine containing 18 to 22 moles of alkylene oxide per mole of tallow amine;

d. 20 to 70 percent by weight of coconut oil, 10 to 50 percent by weight of polyoxyalkylene oleyl ether containing 5 to 20 moles of alkylene oxide per mole of oleyl alcohol, and 5 to 30 percent by weight of polyoxyalkylene stearate containing 4 to 15 moles of alkylene oxide per mole of stearic acid; and e. 100 percent by weight of a polyalkylene glycol ether.

23. A polyamide yarn having incorporated therewith the spin finish of claim 22.

24. A polyester yarn having incorporated therewith the spin finish of claim 22.

25. A spin finish for yarn, made from synthetic organic polymer, to be processed into a yarn that is oil repellent and resistant to soiling, said spin finish comprising:

a. 2 to 20 percent by weight of said spin finish of a first noncontinuous phase comprising:

i. 20 to 50 weight percent of a quaternary ammonium salt selected from the group consisting of trimethyldodecyl ammonium chloride and cocotrimethyl ammonium sulfate; and ii. 50 to 80 weight percent of a fluorochemical compound having the formula

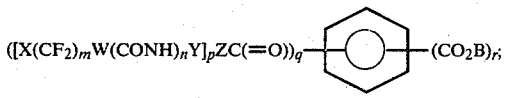

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formula are the same or different;

b. 60 to 93 percent by weight of said spin finish of water; and c. 5 to 20 percent by weight of said spin finish of a second noncontinuous phase which is capable of being emulsified with said first noncontinuous phase and said water without separation of any of the component parts of said spin finish.

26. A polyamide yarn having incorporated therewith the spin finish of claim 25.

27. A polyester yarn having incorporated therewith the spin finish of claim 25.

28. The spin finish of claim 25 wherein said second noncontinuous phase is selected from the group consisting of:

a. 55 percent by weight of coconut oil, 25 percent by weight of polyoxyethylene oleyl ether containing 10 moles of ethlene oxide per mole of oleyl alcohol, 5 percent by weight of polyoxyethylene nonyl phenol containing 9 moles of ethylene oxide per mole of nonyl phenol, and 15 percent by weight of polyoxyethylene stearate containing 8 moles of ethylene oxide per mole of stearic acid;

b. 55 percent by weight of coconut oil, 25 percent by weight of polyoxyethylene oleyl ether containing 10 moles of ethylene oxide per mole of oleyl alcohol, 5 percent by weight of polyoxyethylene oleate containing 5 moles of ethylene oxide per mole of oleic acid, and 15 percent by weight of polyoxyethylene castor oil containing 5 moles of ethylene oxide per mole of castor oil;

c. 44.5 percent by weight of butyl stearate, 27.75 percent by weight of sorbitan monooleate, and 27.75 percent by weight of polyoxyethylene tallow amine containing 20 moles of ethylene oxide per mole of tallow amine.

d. 50 percent by weight of coconut oil, 30 percent by weight of polyoxyethylene oleyl ether containing 10 moles of ethylene oxide per mole of oleyl alcohol, and 20 percent by weight of polyoxyethylene stearate containing 8 moles of ethylene oxide per mole of stearic acid; and e. 100 percent by weight of a polyalkyene glycol ether.

29. A polyamide yarn having incorporated therewith the spin finish of claim 28.

30. A polyester yarn having incorporated therewith the spin finish of claim 28.

* * * * *